US006679169B2

(12) United States Patent
Anweiler et al.

(10) Patent No.: US 6,679,169 B2
(45) Date of Patent: Jan. 20, 2004

(54) INK CONTROL MODEL FOR CONTROLLING THE INK FEED IN A MACHINE WHICH PROCESSES PRINTING SUBSTRATES

(75) Inventors: Werner Anweiler, Bruchsal (DE); Caroline Gateaud, Leimen (DE); Axel Hauck, Karlsruhe (DE); Martin Mayer, Ladenburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/279,271

(22) Filed: Oct. 24, 2002

(65) Prior Publication Data

US 2003/0084800 A1 May 8, 2003

(30) Foreign Application Priority Data

Oct. 25, 2001 (DE) ..... 101 52 158

(51) Int. Cl.[7] ..... B41F 31/00

(52) U.S. Cl. ..... 101/350.1; 101/364; 101/365; 101/350.4

(58) Field of Search ..... 101/350.1, 49, 101/207, 364, 365, 350.4, 208, 204, 210, 330, 331, 340, 347

(56) References Cited

U.S. PATENT DOCUMENTS

| | | | | |
|---|---|---|---|---|
| 3,835,777 A | * | 9/1974 | Krygeris | 101/350.4 |
| 4,660,159 A | | 4/1987 | Ott | 364/526 |
| 4,665,496 A | | 5/1987 | Ott | 364/526 |
| 5,170,711 A | * | 12/1992 | Maier et al. | 101/365 |
| 5,365,847 A | | 11/1994 | Pers | 101/248 |
| 5,551,342 A | | 9/1996 | Fuchs et al. | 101/484 |
| 6,318,260 B1 | * | 11/2001 | Chu et al. | 101/365 |
| 6,477,954 B1 | * | 11/2002 | Doherty | 101/365 |

FOREIGN PATENT DOCUMENTS

| | | | | |
|---|---|---|---|---|
| DE | 2734156 A | * | 2/1978 | B41F/1/46 |
| DE | 19724171 | | 10/1997 | |
| EP | 0142469 | | 5/1985 | |
| EP | 0585740 | | 3/1994 | |
| EP | 0659559 | | 6/1995 | |

* cited by examiner

*Primary Examiner*—Andrew H. Hirshfield
*Assistant Examiner*—Mina Chau
(74) *Attorney, Agent, or Firm*—Davidson, Davidson & Kappel, LLC

(57) ABSTRACT

The present invention relates to a method for controlling the ink feed in a printing press which processes printing substrates (12) and features at least one inking unit and one computer and to a device for carrying out the method. The present invention is characterized in that the computer knows at least the physical properties of printing ink and/or printing substrates (12) as data, that the stored data is read into an ink control model which is stored in the computer, and that the optimum settings with regard to the ink feed are made on the basis of this ink control model before the start of printing or during the printing process.

14 Claims, 2 Drawing Sheets

INK CONTROL MODEL FOR CONTROLLING THE INK FEED IN A MACHINE WHICH PROCESSES PRINTING SUBSTRATES

Priority to German Patent Application No. 101 52 158.8, filed Oct. 25, 2001 and hereby incorporated by reference herein, is claimed.

BACKGROUND INFORMATION

The present invention relates to a method for controlling the ink feed of a machine which processes printing substrates and features at least one inking unit and a computer and to a device which is suitable for carrying out the method.

In the production of printed matter, it is important, above all, that the products leaving a printing press correspond as far as possible to an original copy provided by a customer. This results in complex adjustment procedures, in particular, in the case of sheet-fed printing presses, because, compared to web-fed rotary printing presses, the jobs change much more frequently here. The settings of the printing press have to be changed for each job change, which is very time-consuming. In addition to changing the printing plates on the individual printing units of the printing press, these settings also include those the for the inking unit of each printing unit, especially when the inks in the inking units have to be changed. In this context, the adjustment of the inking unit and thereby of the ink feed depends on many parameters, including the printing speed of the printing press as well as environmental factors such as air humidity and temperature in addition to properties of the printing substrates and the printing inks.

To avoid unnecessary spoilage, state-of-the-art printing presses are calibrated to specific printing inks and specific paper so that spoilage can be reduced using these specific consumables. However, this results in only very limited success because the printing ink properties are subject to relatively large variations, resulting in considerable spoilage in spite of the calibration. For this reason, many printing presses operate with measuring systems which measure the finished, printed sheets or parts of the sheets opto-electronically, mostly on the basis of spectra, the measurements being subsequently compared to an original copy which is measured in the same manner. The differences between the original copy and the printed product determined in this comparison are then used to appropriately adjust the ink feed of the inking units until, in accordance with the requirements, the original copy and the printed product no longer differ. In this case, an OK sheet exists and the print run can start.

A method of that kind is known from European Patent Application No. EP 0 585 740 A1, where screen tints of individual printing colors or of the whole print are photo-electrically scanned and the reflectance values obtained in the process are converted to a characteristic curve. The characteristic curve determined in this manner is adjusted to a predetermined reference characteristic curve by influencing the printing process accordingly. The adjustment of the actual characteristic curve to the predetermined reference characteristic curve is accomplished in that a parameter of the actual characteristic curve is varied and in that, using a performance index, that actual characteristic curve of the resulting actual characteristic curves is selected which leads to a particularly good match with the reference characteristic curve. Hence, this is a closed-loop control circuit which measures reflectance values of a printed product and subsequently changes the characteristic curves stored in the printing press accordingly. However, a closed-loop control circuit of that kind can only react because consumption parameters such as ink and paper cannot be taken into account by the control, as a result of which considerable spoilage is produced until the OK sheet is achieved.

BRIEF SUMMARY OF THE INVENTION

An object of the present invention is to provide a method and a device for carrying out the method which are capable, in particular, of taking into account the properties of consumables and of adapting the ink feed according to the properties already before the start of printing.

The present invention provided a method for controlling the ink feed in a machine which processes printing substrates (12) and features at least one inking unit, wherein a computer knows at least the physical properties of printing ink and/or printing substrates (12) as data; the stored data is read into an ink control model which is stored in the computer; and the optimum settings with regard to the ink feed are made on the basis of this ink control model before the start of printing or during the printing process. A device for performing the method is also provided.

The method according to the present invention can preferably be implemented on a printing press having a control computer which is able to exchange signals for controlling one or more inking units. However, it is also possible that a separate computer exists which calculates the optimum settings using the ink control model and that the data is transmitted from the computer to a printing press or to manually entered there. The ink control model can also be implemented on a computer which is provided in the printing press in addition to the control computer. Besides, the data can also be calculated in the preliminary stages. The place of calculation does not matter, it is only crucial that the physical properties of the consumables be available to the ink control model on a computer and that the results be subsequently used to control a printing press.

The control computer or separate computer has stored therein the ink control model in which the physical properties of the consumables such as printing ink and printing substrate or paper, as well as ambient parameters such as air humidity and temperature are mathematically correlated. Because of this, the ink control model stored in the computer is able to control the ink feed of the inking unit on the basis of the physical properties of the printing ink or printing substrates and of the ambient parameters in such a manner that as little spoilage as possible is produced and the set-up time during job change-over can be minimized. To this end, the physical properties of the consumables must be known, whether they are provided by the consumable supplier or whether the consumables are measured accordingly and thus the physical properties are known on the basis of the measurements. Since the different properties of the consumables and the ambient parameters are known and can be introduced into the control of the printing press, the ink control functions of the printing press can be optimally adapted, and much less deviation from the expected printing result is to be expected than if the printed copies were measured only during printing, as in the related art, and possibly considerable deviations from the original copies would have to be found. In the related art, it can take a very long time until the quality of the printed products has reached a satisfactory degree, especially when the physical properties of the printing inks or printing substrates strongly deviate from the usual standard. Using the method according to the present invention, these problems can be prevented to the greatest possible extent through the a priori knowledge of the properties of the printing substrates and printing inks and through the ink control model.

In a first embodiment of the present invention, provision is made for the stored inks to be used by the ink control model for optimum ink presetting. Optimum ink presetting is an important aspect for achieving good printing results in a rapid manner and with as little spoilage as possible. Using the ink control model, the ink presetting can be optimally adjusted in such a manner that no complex readjustments are required during the printing process, as in the related art.

Moreover, provision is made for the stored data to be used by the ink control model for speed compensation in case of a change in printing speed. For each printing speed, there is a printing unit setting that leads to optimum printing results. As soon as the printing speed is changed, the ink feed has to be changed accordingly because otherwise the print quality will deteriorate. To achieve as rapid a speed compensation as possible, it is therefore a great advantage that, using the ink control model, which also takes into account the printing speed, it is possible to precalculate the inking unit settings that are required for the printing speed to be attained. Thus, no complex control loop needs to be started to effectively reduce spoilage during speed changes.

A further advantageous embodiment of the present invention is achieved in that the stored data is used by the ink control model to optimize the pre-inking and/or the ink profile removal, for example through ink doctor removal, during a change in print job or after washing the printing unit. When a change in print job is imminent, the printing ink present in the inking units must be removed to an extent that the inking unit settings can be made for the following print job. The ink must also be built up anew subsequent to washing the inking unit. To minimize the set-up time during a change in print job, it is important that the ink be removed only to the extent that is absolutely necessary. Otherwise, an unnecessarily long time for the ink build-up required for the following print job has to taken into account during the subsequent pre-inking. Therefore, it is a great advantage for the ink removal and the pre-inking for the subsequent print job if the corresponding values for the ink removal and the pre-inking can be precalculated using the ink control model. This is important especially when the printing substrate is changed and the inking unit settings can be adapted accordingly.

In one embodiment of the present invention, provision is made for the data on the physical properties of the printing ink to include spectral reflectance values of the printing ink on the printing substrate used for the printing process. The reflectance values of a printing ink also depend, inter alia, on the printing substrate onto which this printing ink is applied, on the dry state of the ink, and on the layer thickness in which it is printed. Thus, the reflectance values of the printing ink can only be optimally taken into account in the ink control model if the reflectance values of the printing ink were measured on the printing substrate that is actually used in the printing press. This can be accomplished by preliminary spectral measurements of the printing ink on the printing substrate used.

Moreover, it is advantageous that the data on the physical properties of the printing ink includes spectral reflectance values of the printing ink on standard printing substrate. If the spectral reflectance values of the printing ink on the printing substrate which is used in the printing press are not known, then it is required to measure the printing ink on the corresponding printing substrate in advance. To avoid such a preliminary measurement, it is also possible to use values which represent the reflectance values of the printing ink on a standard printing substrate. On the basis of the data on the printing substrate which is actually used for the printing process, the spectral reflectance values of the printing ink of the standard printing substrate are then appropriately converted so that the reflectance values of the printing ink become also meaningful for the printing substrate actually used.

In one embodiment of the present invention, provision is made for the data on the physical properties of the printing ink to include spectral reflectance values for at least two layer thicknesses of the printing ink. In this manner, it is possible to calculate the optimum inking unit settings for a desired coloring using the ink control model.

Moreover, provision is made for the data on the physical properties of the printing ink to include rheological properties under standard conditions. The science of rheology deals with the flow and deformation behavior, in particular, of liquid substances. Rheological parameters include, inter alia, the viscosity and tack of the ink. Thus, the rheological properties of a printing ink depend, inter alia, on the viscosity and the ambient temperature. If the rheological properties of the printing ink under standard conditions as, for example, a certain viscosity range at a certain ambient temperature are known, then the rheological properties of the printing ink can also be obtained for changed conditions by conversion using the ink control model. In this manner, the rheological properties of the printing ink can be integrated into the ink feed.

Moreover, it is an advantage if the data on the physical properties of the printing ink includes a maximum dampening agent absorption capacity and/or a maximum dampening agent absorption rate under standard conditions. Besides an ink metering device, there also exists a dampening agent metering system in a normal printing unit of a printing press. In this manner, dampening agent is supplied to the printing ink on the rollers of the inking unit before the printing ink reaches the plate cylinder of a printing unit. The properties of the printing ink can be influenced via the dampening agent so that it is advantageous if the properties of the dampening agent are also taken into account in the ink control model. Here too, it is possible to infer values under changed conditions from values which are measured under standard conditions.

In a further embodiment of the present invention, provision is made for the physical properties of the printing substrate to include as, for example, surface properties and spectral reflectance values of the of the printing substrate used for a print job or a printing substrate classification. In this manner, the properties of the different printing substrates are introduced into the ink control model and can be taken into account in the ink feed. If the properties of a printing substrate used are not available, then it can possibly be sufficient to know at least the printing substrate classification such as glossy coated, matt coated or uncoated.

It is particularly important that further printing parameters such as the printing unit temperature and/or the printing speed and/or the zonal coverage be available to the computer as data. This data is eminently important to be able to ensure optimum ink feed for a print job. The printing speed can easily be obtained from the machine data of the printing press and thus be fed to the computer. For the inking unit temperature, a suitable thermometer has to be provided which serves as a sensor for the computer and supplies it with the corresponding data. The zonal coverage must be entered into the computer prior to the start of the printing process.

BRIEF DESCRIPTION OF THE DRAWINGS

An exemplary embodiment of the present invention is described and illustrated in greater detail below with reference to several drawings.

DETAILED DESCRIPTION

Figure 1:
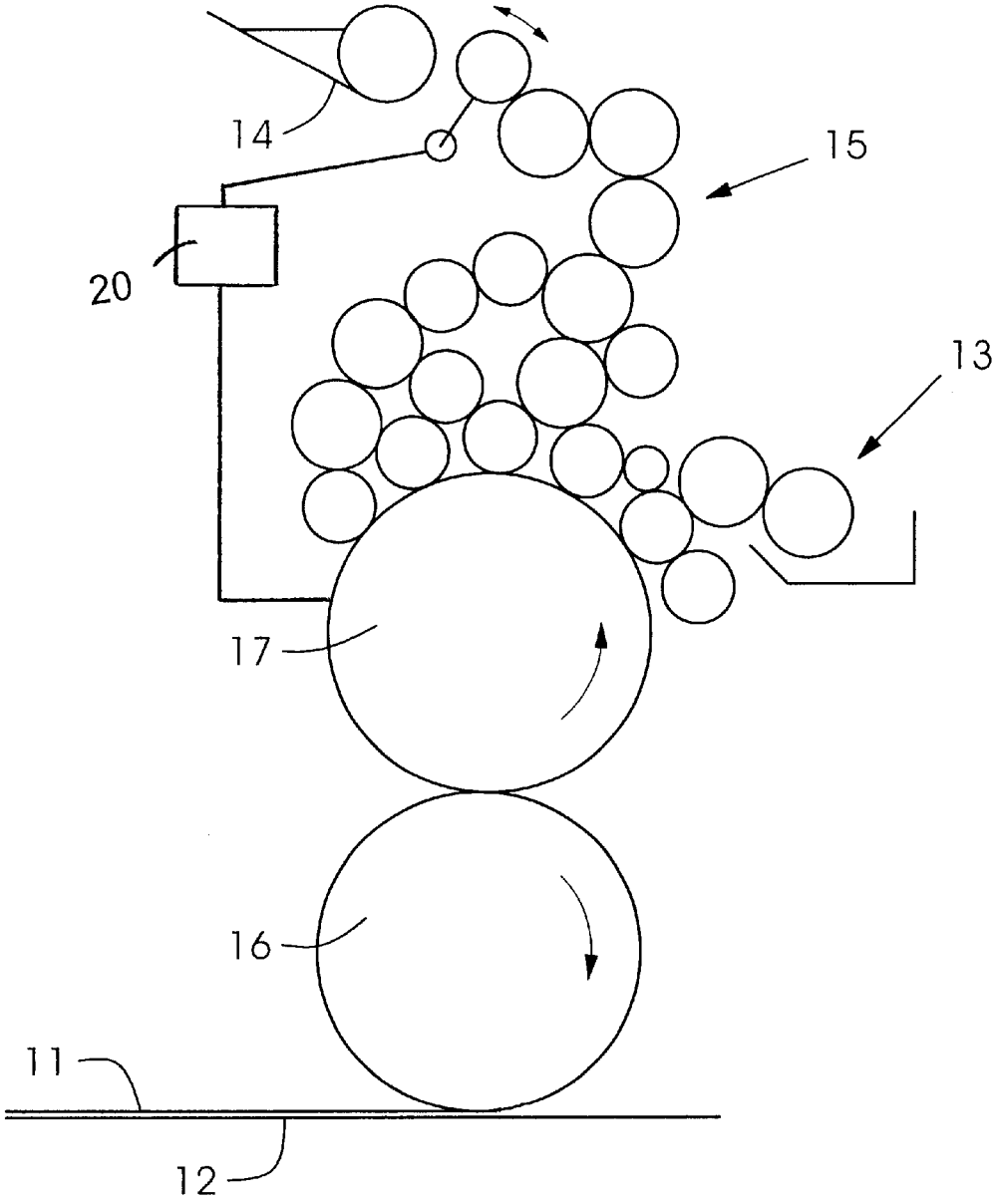
FIG. 1 shows, by way of example, an inking unit and a printing unit of a printing press.

The method according to the present invention can be used in all printing presses which are provided with a sufficiently powerful computer 20 to be able to implement the ink control model. It is also possible to implement the ink control model on a separate computer and to feed the calculated data to the control devices of a printing press. In FIG. 1, a printing unit with an associated inking unit is shown as a segment of a sheet-fed offset printing press. The printing unit is composed of a plate cylinder 17 around which is wrapped a printing plate which was previously imaged with a separation of the motif to be printed. Located below plate cylinder 17 is offset printing cylinder 16 which, in FIG. 1, is designed as a blanket cylinder and which transfers the printing ink from plate cylinder 17 to the surface of a printing substrate 12. To be able to apply the printing ink to plate cylinder 17 in the correct dose, an inking unit is arranged upstream of plate cylinder 17, the inking unit having an ink metering system 14 and a moisture metering system 13. Ink metering system 14 contains the printing ink and moisture metering system 13 a dampening agent. After leaving their respective metering devices, the printing ink and the dampening agent are brought into contact with each other via inking and dampening system rollers 15 so that inking system rollers 15, which contact plate cylinder 17, transfer the desired ink layer to the plate cylinder. In this manner, the printing ink is distributed to the ink-accepting parts of the printing plate of plate cylinder 17 and transferred by the plate cylinder as a print image to offset printing cylinder 16. Then, offset printing cylinder 16 rolls off of printing substrate 12, thus applying the print image to printing substrate 12. By appropriate control of the moisture and ink metering systems 13, 14 and taking into account the printing speed of the printing press, a print image is formed on printing substrate 12 with a certain layer thickness 11. Ink metering system 14 and moisture metering system 13 can receive signals from the computer 20 of the printing press to be able to change the print image. Moreover, the computer 20 can act on the main drive of the printing press, which drives plate cylinder 17, offset cylinder 16 and transport cylinders (not shown here), thus regulating the printing speed of the whole printing press.

Experience has shown that the consumption parameters ink and printing substrate 12 have a great influence on the print image so that it is extremely desirable for the properties of the printing ink and of printing substrate 12 to be taken into account in the control of the inking unit. This is also true, in particular, when using special colors since the manufacturing tolerances are even greater here. The printing inks and printing substrates 12 have a plurality of physical properties which are fed to the computer as data before the start of printing. Of course, this requires that the physical properties of the printing ink and of printing substrate 12 be known. The physical properties of the printing ink that are considered to be relevant are, for example, the spectral reflectance values on the current printing substrate. In the present exemplary embodiment, the spectral reflectance values of the ink on printing substrate 12 used are available for two layer thicknesses 11. In this example, layer thicknesses 11 are 0.9 and 1.3 micrometers. Alternatively, it is also possible to use the spectral reflectance values of the printing ink on standard printing substrate 12; here too, the intention being for the spectral reflectance values to be available for two layer thicknesses of 0.9 and 1.3 micrometers. Moreover, it is required to know the Theological properties of the printing ink under standard conditions as well as the physical properties of the printing substrate. In the present exemplary embodiment, a viscosity in the range of a shear rate of 10–300 l/s at an ambient temperature of 28 degrees Celsius are considered to be standard conditions. Also known is the maximum dampening agent absorption and dampening agent absorption rate for the used dampening agent, also under standard external conditions.

In the case of printing substrate 12, the physical properties of printing substrate 12 used must be available since in the case of the printing ink, only the properties for a standard printing substrate are known. For the ink control model underlying the present invention, unless the physical properties of the printing substrate used are known, it is alternatively required to know printing substrate classification I, that is, glossy coated, matt coated or uncoated. According to FIG. 2, the required layer thickness 11 is calculated for a predetermined desired coloring in full tone from the reflectance values of the ink on current printing substrate 12 or by converting the reflectance values on standard printing substrate and from the reflectance and surface properties of printing substrate 12. Then, required layer thickness 11 and the rheological parameters, together with further printing parameters such as the inking unit temperature, the printing speed and the zonal coverage, go into the ink control model so that the optimum settings for the ink presetting, speed compensation in case of a change in printing speed and for job change functions can be determined. The functions for a change in print job include, for example, a first pre-inking and a second pre-inking as well as an ink profile removal.

Figure 4:
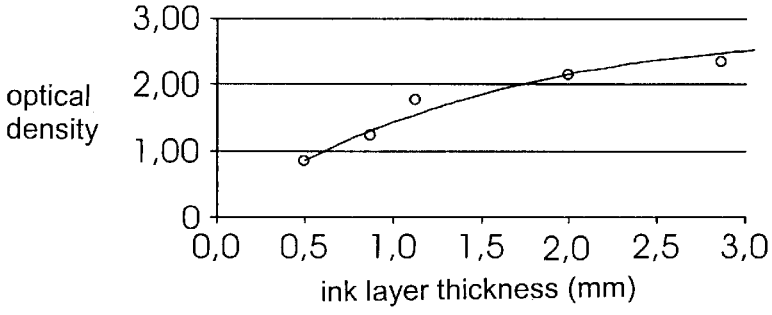
FIG. 4 is a diagram featuring a Tollenaar curve.

In the case of process colors, alternatively to calculating the required layer thickness from the spectra of the process colors, the required layer thickness can be determined from the so-called "Tollenaar curve" for a predetermined desired density. Such a Tollenaar curve is shown in FIG. 4 in which the optical density of the color is plotted over the ink layer thickness. The Tollenaar curve shown refers to coated paper with the printing color cyan. Given a desired density of 1.45, an ink layer thickness of 1.03 micrometers is derived from the Tollenaar curve according to FIG. 4.

Figure 2:
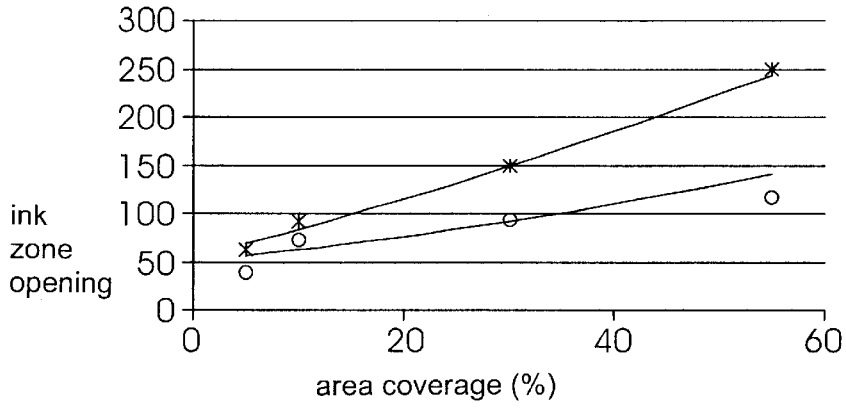
FIG. 2 shows a diagram which correlates the ink zone opening with the area coverage, taking account of further parameters.

FIG. 2 shows the ink zone or key opening plotted over the area coverage in % for a printing speed of 6000 prints per hour, coated paper as printing substrate 12, using the printing color black. In this context, the small circles in FIG. 2 represent the measured values for an ink stripe width of 70% and the crosses represent the measured values for an ink stripe width of 30%. The lower curve stands for the values that are calculated according to the ink control model for an ink stripe width of 70% while the upper curve shows the values calculated by the ink control model for an ink stripe width of 30%. The determination the characteristic curves for ink presetting shown in FIG. 2 is an object of the ink control model.

Figure 3:
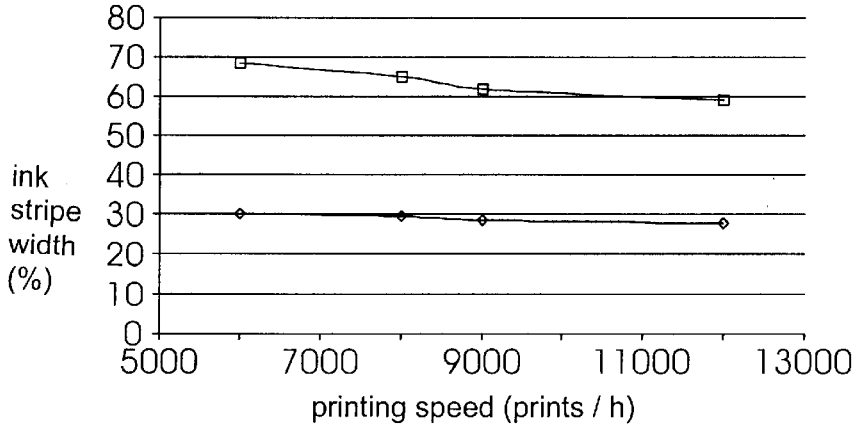
FIG. 3 shows a diagram relating to the speed compensation.

Further goals are the characteristic curves of the speed compensation according to FIG. 3. Here, the ink stripe width in % is plotted over the printing speed in prints/h. The upper curve corresponds to an ink stripe width of 70%, the lower curve to an ink stripe width of 30%.

For optimum adaptation of the ink control, it is also required to known the ink viscosity in addition to the ink layer thickness required for the desired coloring. Unless the ink viscosity is known from the manufacturer, it can be measured using a cone/plate rheometer. The ratio FZ/SD, ink zone opening FZ to ink layer thickness SD, is to be calculated as a target quantity of the ink control model. Area coverage FD, ink stripe width bf, printing speed V, ink viscosity η as well as their double interactions are taken into account as influence variables.

The ink control model manifests itself as a polynomial of $n^{th}$ degree having the following form:

$$\frac{FZ}{SD} = a_0 + a_1 \cdot FD + a_2 \cdot \frac{1}{bf} + a_3 \cdot \eta + a_4 \cdot V + a_5 \cdot FD \cdot \frac{1}{bf} + a_6 \cdot V \cdot \eta + a_7 \cdot \frac{1}{bf} \cdot \eta + a_8 \cdot FD \cdot \eta + a_9 \cdot \eta^2 + a_{10} \cdot \left(\frac{1}{bf}\right)^2 + a_{11} \cdot FD^2 + \ldots$$

For n=11, the values of the table below are derived as the coefficients of the model $a_0$ to $a_n$. They are valid for a printing speed range V between 3000 and 15000 prints per hour, an area coverage FD between 0 and 100 percent and an ink stripe width bf between 5 and 95 percent. In this connection, viscosity η of the printing ink can range between 30 and 80 Pas.

TABLE

| | |
|---|---|
| $a_0$ = | −190.84330 |
| $a_1$ = | 1.40819 |
| $a_2$ = | 2417.30481 |
| $a_3$ = | 5.77374 |
| $a_4$ = | 0.00249 |
| $a_5$ = | 92.28895 |
| $a_6$ = | −0.00006 |
| $a_7$ = | −20.47044 |
| $a_8$ = | −0.02326 |
| $a_9$ = | −0.03387 |
| $a_{10}$ = | −13420.28210 |
| $a_{11}$ = | 0.01135 |

After the quadratic terms, the polynomial of the ink control model is truncated. This has turned out to be sufficient for the accuracy of the ink control model under the mentioned conditions.

Using the curves for ink presetting according to FIG. 2 and the curves for speed compensation according to FIG. 3 as well as the parameters for the pre-inking that have been calculated by the computer on the basis of the ink control model, the ink feed of the printing press for the imminent print job can be optimally controlled in that the computer controls moisture metering system 13, ink metering system 14 and the drive motor of the printing press accordingly.

LIST OF REFERENCE SYMBOLS

11 Layer thickness
12 Printing substrate
13 Dampening agent metering system
14 Ink metering system
15 Inking and dampening system rollers
16 Offset printing cylinder
17 Plate cylinder
20 Computer

What is claimed is:

1. A method for controlling ink feed in a device for processing a printing substrate, the device including at least one inking unit, the method including the steps of:

storing data in a computer, the stored data including at least the physical properties of printing ink and/or printing substrates;

reading the stored data into an ink control model stored in the computer; and setting optimum settings with regard to the ink feed as a function of the ink control model before a start of a printing process or during the printing process.

2. The method as recited in claim 1 wherein the stored data is used by the ink control model for optimum ink setting before the start of the printing process.

3. The method as recited in claim 1 wherein the stored data is used by the ink control model for speed compensation in case of a change in printing speed.

4. The method as recited in claim 1 wherein the stored data is used by the ink control model to optimize the pre-inking and/or the ink profile removal during a change in print job or after washing the printing unit.

5. The method as recited in claim 1 wherein the stored data includes data on physical properties of the printing ink including spectral reflectance values of the printing ink on the printing substrate used for the printing process.

6. The method as recited in claim 1 wherein the stored data includes data on physical properties of the printing ink including spectral reflectance values of the printing ink on a standard printing substrate.

7. The method as recited in claim 1 wherein the stored data includes data on physical properties of the printing ink including spectral reflectance values for at least two layer thicknesses of the printing ink.

8. The method as recited in claim 1 wherein the stored data includes data on physical properties of the printing ink including Theological properties under standard conditions.

9. The method as recited in claim 1 wherein the stored data includes data on physical properties of the printing ink including a maximum dampening agent absorption capacity and/or a maximum dampening agent absorption rate under standard conditions.

10. The method as recited in claim 1 wherein the stored data includes data on the physical properties of the printing substrate including spectral reflectance values of the printing substrate used for a print job or a printing substrate classification.

11. The method as recited in claim 1 wherein the stored data includes data on the physical properties of the printing substrate including surface properties of the printing substrate used for a print job.

12. The method as recited in claim 1 further comprising providing further printing parameters to the computer.

13. The method as recited in claim 12 wherein the further printing parameters include such as the printing unit temperature and/or the printing speed and/or the zonal coverage.

14. A device for processing a printing substrate comprising:

at least one inking unit, a computer for controlling the at least one inking unit, the computer having stored data including at least the physical properties of printing ink and/or printing substrates and an ink control model for receiving the stored data, the computer calculating optimum settings with regard to an ink feed of the at least one inking unit as a function of the ink control model before a start of a printing process or during the printing process.

* * * * *